US006299156B1

(12) United States Patent
Kaneda et al.

(10) Patent No.: US 6,299,156 B1
(45) Date of Patent: Oct. 9, 2001

(54) SHEET SUPPLY SYSTEM

(75) Inventors: Hiroshi Kaneda; Masao Suzuki; Hideaki Inoue, all of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/285,646

(22) Filed: Apr. 5, 1999

(30) Foreign Application Priority Data

Apr. 8, 1998 (JP) ..... 10-096234

(51) Int. Cl.[7] ..... B65H 3/06

(52) U.S. Cl. ..... 271/117; 271/3.08; 271/3.09; 271/8.1; 271/145; 271/147; 271/148

(58) Field of Search ..... 271/3.08, 3.09, 271/117, 3.13, 110, 8.1, 145, 147, 148, 155, 264, 157

(56) References Cited

U.S. PATENT DOCUMENTS

| | | | | |
|---|---|---|---|---|
| 4,252,251 | | 2/1981 | Ek et al. | 221/227 |
| 4,832,329 | * | 5/1989 | Rodi et al. | 271/155 |
| 4,976,421 | * | 12/1990 | Kanaya | 271/258 |
| 5,397,118 | * | 3/1995 | Iida et al. | 271/155 |
| 5,556,252 | | 9/1996 | Kuster | 414/796.7 |
| 5,716,046 | * | 2/1998 | Katamoto et al. | 271/3.08 |

FOREIGN PATENT DOCUMENTS

| | | | | |
|---|---|---|---|---|
| 0 613 845 A1 | | 9/1994 | (EP) | B65H/1/14 |
| 0 738 677 A1 | * | 3/1996 | (EP) | B65H/1/14 |
| 0 738 677 A1 | | 10/1996 | (EP) | B65H/1/14 |

* cited by examiner

*Primary Examiner*—Donald P. Walsh
*Assistant Examiner*—Mark J. Beauchaine
(74) *Attorney, Agent, or Firm*—Nixon Peabody LLP; Donald R. Studebaker

(57) ABSTRACT

A sheet supply system includes a sheet support table which is movable up and down and on which a stack of a plurality of sheets are supported, a sheet feed-out roller which feeds out the sheets on the sheet support table one by one from the uppermost one, and a table drive mechanism which moves the sheet support table up and down relative to the sheet feed-out roller. A level sensor detects the level of the uppermost sheet on the sheet support table, and a sheet feed-out level at which the uppermost sheet is kept during sheet supply operation of the system is set by use of an entry key. A controller actuates the table drive mechanism to move upward the sheet support table when the level of the uppermost sheet on the sheet support table as detected by the level sensor lowers by a predetermined value from the sheet feed-out level and stops the table drive mechanism when the level of the uppermost sheet on the sheet support table as detected by the level sensor reaches the sheet feed-out level.

11 Claims, 7 Drawing Sheets

PRIOR ART

SHEET SUPPLY SYSTEM

BACKGROUND OF THE INVENTION

1. Field of the Invention

This invention relates to a sheet supply system, and more particularly to a sheet supply system which feeds out sheets stacked on a sheet support table one by one from the sheet support table.

2. Description of the Related Art

For example, in a stencil printer, a number of printing papers are supplied to a printing system one by one without lost feed (referring to malfunction that no printing paper is supplied) or multiple feed (referring to malfunction that a plurality of printing paper are supplied at one time).

In the stencil printer, a number of copies are often printed from one original, and accordingly a number of printing papers are stacked on a paper support table. In such a case, it is preferred that the uppermost printing paper in the stack on the support table be constantly positioned at a predetermined level (will be referred to as "the paper feed-out level", hereinbelow) so that a paper feed-out system can act on the uppermost printing paper constantly in an optimal manner. For this purpose, the paper support table is moved upward as the level of the uppermost printing paper in the stack remaining on the paper support table lowers.

FIG. 8 shows an example of a conventional paper supply system for a stencil printer. In FIG. 8, reference numeral 51 denotes a paper support table on which a stack of printing papers P is supported. The paper support table 51 is moved up and down by a table drive means (not shown). The printing papers P are fed out from the paper support table 51 one by one by a paper feed-out unit 53. The paper feed-out unit 53 comprises a pair of paper feed rollers (a scraper roller 54*a* and a pick-up roller 54*b*) which are mounted for rotation on one bracket and are rotated in synchronization with each other. The paper feed-out unit 53 is rotatable about a shaft 53*a* and is moved upward when the paper support table 51 is moved upward and the uppermost printing paper in the stack of the printing papers P pushes upward the scraper roller 54*a*. The shaft 53*a* is urged by a spring means (not shown) so that the contact pressure between the scraper roller 54*a* and the uppermost printing paper increases as the paper feed-out unit 53 is lifted higher.

A limit switch 52, which may be, for instance, a microswitch or a photo-interrupter, is disposed to be opened when the paper feed-out unit 53 is moved upward to a predetermined level. That is, when paper support table 51 is moved upward to push the paper feed-out unit 53 upward and the limit switch 52 is opened, the table drive means is de-energized and the paper support table 51 is stopped at the level. When the printing papers P on the support table 51 are fed out from the paper support table 51 and the level of the uppermost printing paper lowers, the limit switch 52 is closed again and the table drive means is energized to move upward the paper support table 51. In this manner, the uppermost printing paper is constantly kept at the level at which the limit switch 52 is opened, thereby keeping constant the contact pressure between the uppermost printing paper and the scraper roller 54*a* during paper supply operation of the paper supply system. The level of the uppermost printing paper at which the limit switch 52 is opened is the aforesaid "paper feed-out level".

However the conventional system is disadvantageous in that since the paper feed-out level is controlled by opening and closure of the limit switch 52, the accuracy in positioning the uppermost printing paper at the paper feed-out level is governed by the sensitivity of the limit switch 52, which fluctuates from switch to switch and changes with time. When the paper feed-out level fluctuates, the contact pressure between the uppermost printing paper and the scraper roller 54*a* fluctuates, which causes the aforesaid lost feed or the aforesaid multiple feed. Further, it takes a movement of the paper support table 51 through a certain distance to open and close the limit switch 52. The distance is generally larger than the thickness of one printing paper and is generally equal to triple of the thickness of the printing paper. Accordingly, the level of the uppermost printing paper is adjusted only once per three printing papers, which results in fluctuation in the contact pressure during supply of the three printing papers.

There are used various types of printing papers which are different in thickness, quality and the like. The contact pressure optimal to feed the printing papers one by one differs according to the thickness, quality and the like of the printing paper. Thus there has been proposed, as disclosed in Japanese Unexamined Patent Publication No. 8(1996)-259099, a paper supply system in which the contact pressure between the uppermost printing paper and the scraper roller (i.e., the paper feed-out level) can be changed. In the paper supply system, the position of the limit switch 52 relative to the paper feed-out unit 53 is changed in two steps by operation of a lever so that the contact pressure between the uppermost printing paper and the scraper roller 54*a* at the level of the uppermost printing paper at which the limit switch 52 is opened is changed in two steps. When thick printing papers are to be supplied, the contact pressure is increased and when thin printing papers are to be supplied, the contact pressure is reduced.

Also this system cannot be free from the aforesaid drawbacks inherent to the limit switch and since the paper feed-out level is changed by changing the position of the limit switch relative to the paper feed-out unit, an additional mechanism is required, which adds to the manufacturing cost of the system.

Further printing papers of different thicknesses can be sometimes stacked on the paper support table, and accordingly there is a demand for a paper supply system which can automatically change the paper feed-out level according to the thickness of the printing paper.

SUMMARY OF THE INVENTION

In view of the foregoing observations and description, the primary object of the present invention is to provide a sheet supply system in which the sheet feed-out level can be accurately controlled and at the same time, the sheet feed-out level can be arbitrarily set without adding to the manufacturing cost of the system.

Another object of the present invention is to provide a sheet supply system in which the sheet feed-out level is automatically corrected according to the actual thickness of the printing papers.

In accordance with the present invention, there is provided a sheet supply system comprising

- a sheet support table which is movable up and down and on which a stack of a plurality of sheets are supported,
- a sheet feed-out means which feeds out the sheets on the sheet support table one by one from the uppermost one,
- a table drive means which moves the sheet support table up and down relative to the sheet feed-out means,
- a level sensor which detects the level of the uppermost sheet on the sheet support table, a sheet feed-out level setting means for initially setting a sheet feed-out level at which the uppermost sheet is kept during sheet supply operation of the system, and a control means which actuates the table drive means to move upward the sheet support table when the level of the uppermost sheet on the sheet support table as detected by the level sensor lowers from the sheet feed-out level as set by the sheet feed-out level setting means by a predetermined value and stops the table drive means when the level of the uppermost sheet on the sheet support table as detected by the level sensor reaches the sheet feed-out level.

In the sheet supply system with this arrangement, since the level sensor continuously detects the level of the uppermost sheet in the stack on the sheet support table and the table drive means is stopped when the level of the uppermost sheet on the sheet support table as detected by the level sensor reaches the sheet feed-out level, the sheet feed-out level can be controlled more accurately as compared with when the table drive means is stopped when an on-off limit switch is opened. Further, since the level sensor is more sensitive than the on-off limit switch and can detects the difference in the level which is as small as the thickness of one sheet, the level of the uppermost sheet can be returned to the sheet feed-out level each time one sheet is fed out from the sheet support table, whereby the uppermost sheet to be fed out next can be constantly kept at an optimal level.

It is preferred that said control means includes a correction means which changes said sheet feed-out level set by the sheet feed-out level setting means according to the thickness of each sheet as calculated on the basis of reduction in the level of the uppermost sheet as detected by the level sensor which is caused each time a sheet is fed out from the sheet support table.

With this arrangement, the sheet feed-out level can be automatically optimized even if the sheet feed-out level which is initially set by the sheet feed-out level setting means is improper or the thickness of the sheets in the stack fluctuates.

DESCRIPTION OF THE PREFERRED EMBODIMENTS

Figure 2:
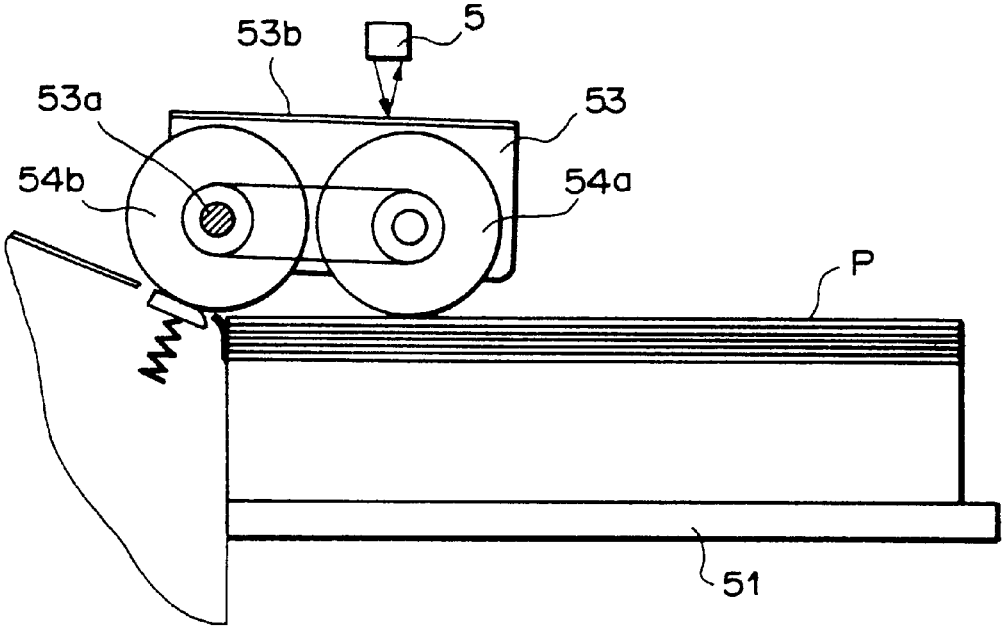
FIG. 2 is a schematic side view showing the mechanical structure of the paper supply system.
Figure 8:
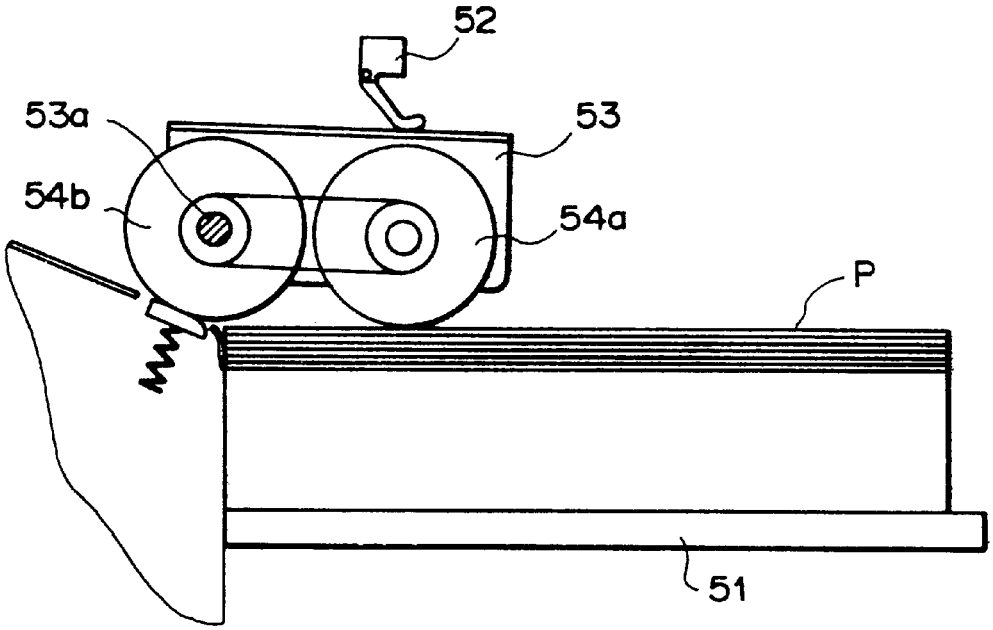
FIG. 8 is a schematic side view showing the mechanical structure of a paper supply system in accordance with a prior art.

FIG. 2 shows an important part of a printing paper supply system in accordance with an embodiment of the present invention. The part shown in FIG. 2 is similar to that shown in FIG. 8 except that a level sensor 5 is provided instead of the limit switch 52, and accordingly the elements analogous to those shown in FIG. 8 are given the same reference numerals and will not be described here.

Figure 1:
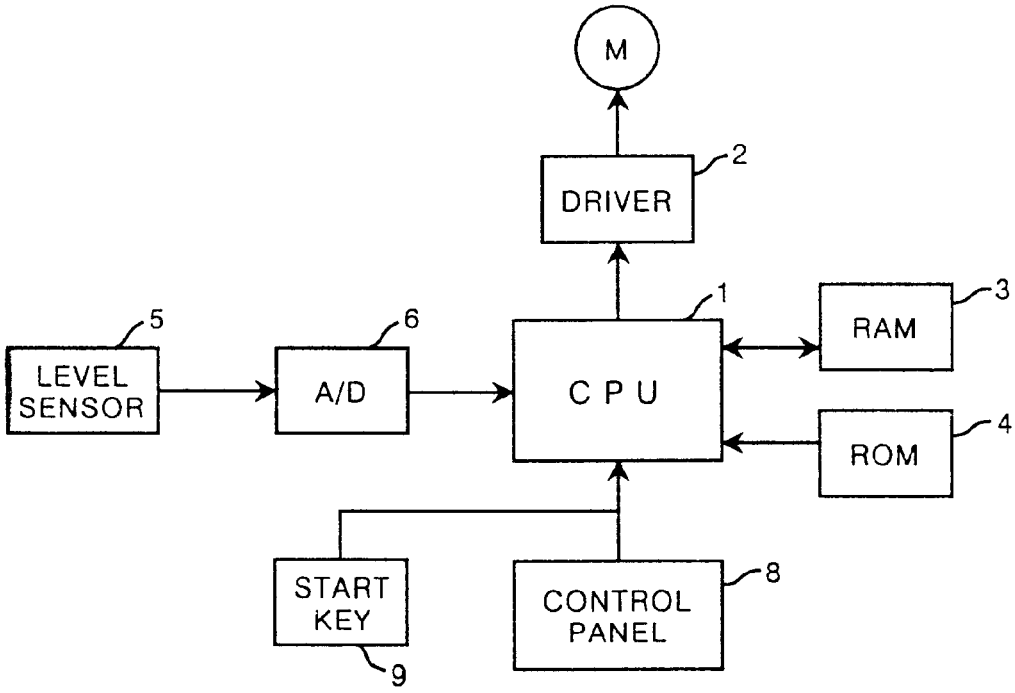
FIG. 1 is a block diagram showing a circuit for controlling the paper support table drive mechanism in a paper supply system in accordance with an embodiment of the present invention.

When printing papers P stacked on the paper support table 51 are continuously supplied to a printing section (not shown), the level of the paper support table 51 is controlled so that the uppermost printing paper in the stack is constantly held at a predetermined level (the paper feed-out level). The level of the paper support table 51 is adjusted by a paper support table drive mechanism (not shown) which is driven by a motor M (FIG. 1). The paper supply system of the present invention is characterized by the manner of controlling the paper support table drive mechanism, that is, the manner of controlling the motor M. Accordingly, description will be made mainly on the control of the motor M, hereinbelow.

In this particular embodiment, the level sensor 5 is a range finder which is positioned at a fixed height and continuously detects the distance of the paper feed-out unit 53 from the level sensor 5, thereby detecting the level of the uppermost printing paper in the stack on the paper support table 51. That is, the level sensor 5 emits a light beam toward a reflecting plate 53*b* fixed to the paper feed-out unit 53 and receives reflected light from the reflecting plate 53*b*. The level sensor 5 outputs a detecting signal the voltage of which increases as the distance between the reflecting plate 53*b* and the level sensor 5 is reduced.

The detecting signal from the level sensor 5 is digitized by an A/D convertor 6 and input into a CPU (control means) 1. The CPU 1 uses a RAM 3 and a ROM 4 as memories for executing operation.

A control panel 8 is connected to the CPU 1. The control panel 8 is provided with a paper thickness entry key (not shown) for selecting a thickness out of a plurality of thicknesses, e.g., thick, standard and thin. When a print start key 9 is pressed after the thickness of the printing papers P is selected through the paper thickness entry key, the CPU 1 starts processing.

Figure 4:
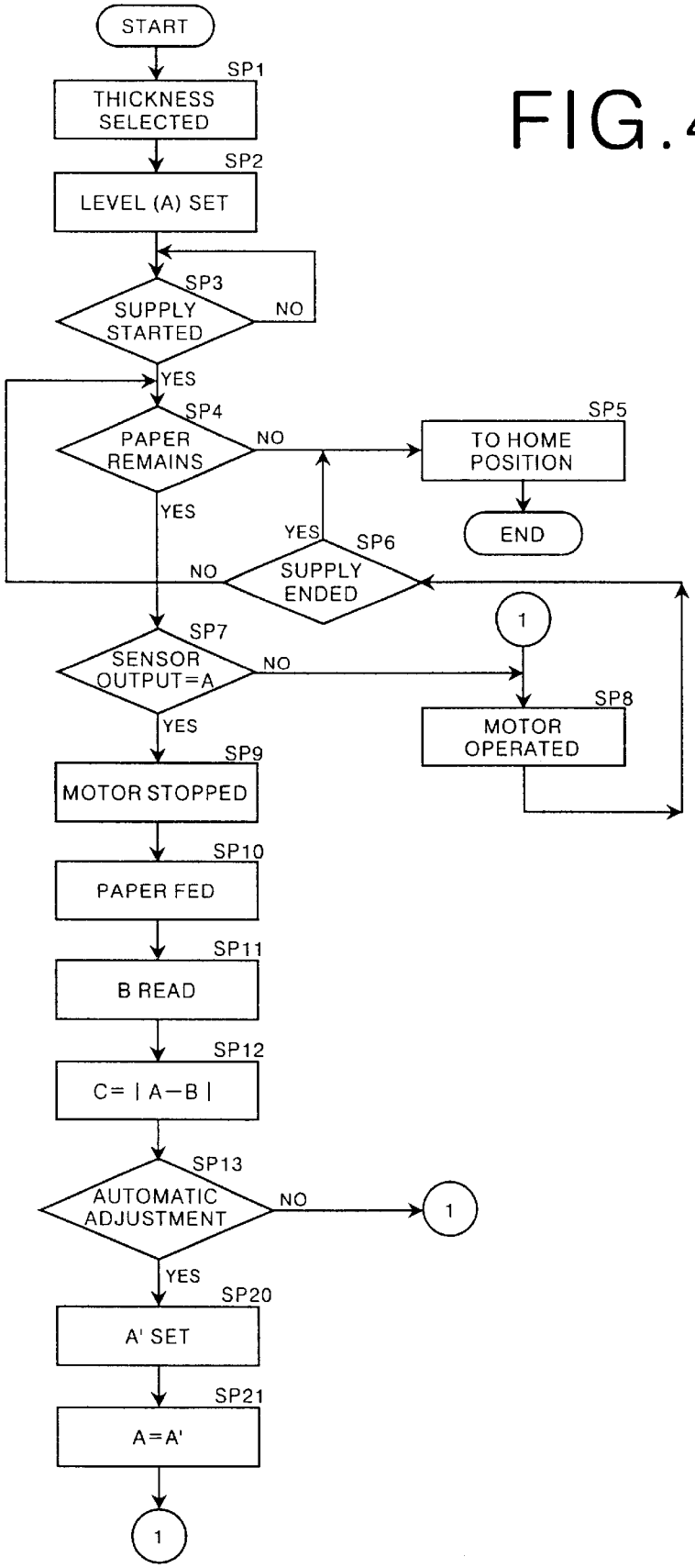
FIG. 4 is a flow chart for illustrating the operation of the CPU.

The processing to be executed by the CPU 1 will be described with reference to the flow chart shown in FIG. 4, hereinbelow.

When the user selects the thickness of the printing papers P by use of the paper thickness entry key (step SP1), the CPU 1 sets a paper feed-out level A corresponding to the selected thickness of the printing papers P (step SP2). A plurality of paper feed-out levels corresponding to a plurality of thicknesses of the printing papers are stored in the ROM 4 in the form of a look-up table and the CPU 1 reads out a paper feed-out level A corresponding to the selected thickness of the printing papers.

Figure 3:
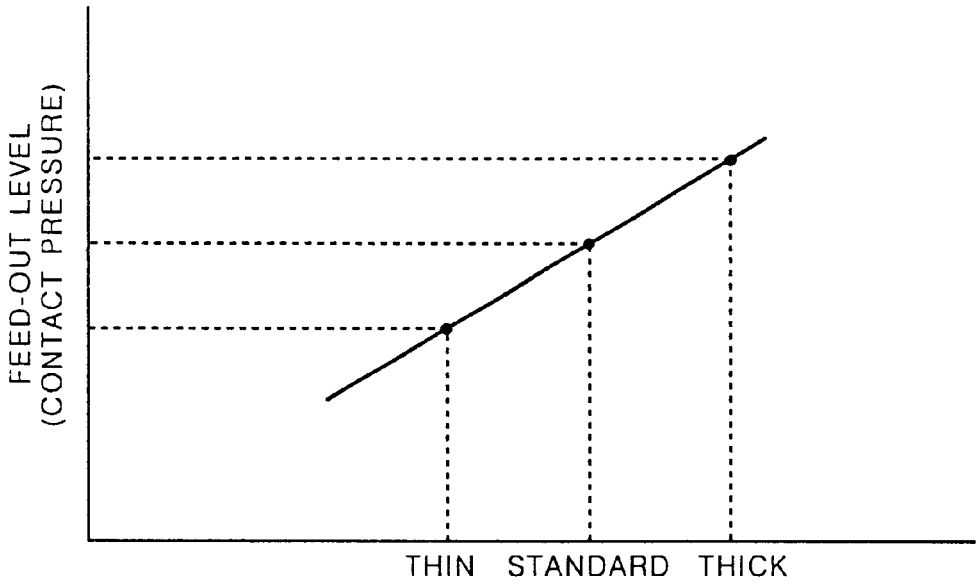
FIG. 3 is a graph showing the relation between the thickness of the printing paper and the paper feed-out level.

As shown in FIG. 3, as the thickness of the printing paper increases, the paper feed-out level A is increased so that the contact pressure between the scraper roller 54*a* and the uppermost printing paper increases. Though the relation between the thickness of the printing paper and the paper feed-out level A is represented by a linear line in FIG. 3, the relation may be represented by other lines.

When the user presses a sheet supply start key on the control panel 8 (in the case where the sheet supply system of this embodiment is connected to a printer, a printing start key of the printer functions as the sheet supply start key) (step SP3: YES), the CPU 1 starts to supply printing papers P one by one up to a number set by the user by use of an entry means provided on the control panel 8.

That is, the CPU 1 first determines whether there are printing papers P on the paper support table 51. (step SP4)

When it is determined that there remains no printing paper P on the paper support table 51, the CPU 1 moves the paper support table 51 to a home position where the printing papers P are positioned away from the paper feed-out unit 53 or keeps the paper support table 1 in the home position and gives alarm to indicate that the paper support table 51 should be replenished with printing papers P. (step SP5) When it is determined that there remains printing papers P on the paper support table 51, the CPU 1 causes a motor driver 2 (FIG. 1) to operate the motor M (for driving the table drive mechanism) to move upward the paper support table 51 to the paper feed-out level A. (via steps SP7, SP8, SP6 and SP4) When the paper support table 51 reaches the paper feed-out level A (step SP7: YES), the motor M is stopped (step SP9) and the uppermost printing paper is fed out (step SP10). Then the output B of the level sensor 5 is read (step SP11) and the thickness C of the printing paper P just fed out is obtained on the basis of the difference between the paper feed-out level A and the output B, i.e., C=|A−B|, (step SP12). Then when an automatic adjustment mode (to be described later) has not been selected (step SP13: NO), the CPU 1 causes the motor driver 2 to operate the motor M to move upward the paper support table 51 to the paper feed-out level A. (via steps SP7, SP8, SP6 and SP4) In this manner, the paper support table 51 is moved upward to hold the uppermost printing paper for that time at the paper feed-out level A each time a printing paper is fed out, whereby the scraper roller 54*a* can act on the uppermost printing paper constantly at an optimal contact pressure and can feed the printing papers P surely one by one without lost feed or multiple feed. After a predetermined number of printing papers P are fed out from the paper support table 51 (SP6: YES), the paper support table 51 is returned to the home position (step SP5) and the processing is ended.

In the automatic adjustment mode, the paper feed-out level A is automatically corrected according to the thickness of the printing paper P. The automatic adjustment mode is selected by use of a suitable key or the like provided, for instance, on the control panel 8. When the automatic adjustment mode has been selected (step SP13: YES), the CPU 1 reads out from the ROM 4 a paper feed-out level A' corresponding to the thickness C calculated in step SP12 (step SP20), and substitutes A' for A (step SP21). Then the next time, the CPU 1 causes the motor driver 2 to operate the motor M to move upward the paper support table 51 to the corrected paper feed-out level A'. (via steps SP7, SP8, SP6 and SP4)

Thus, in the automatic adjustment mode, the paper feed-out level A can be automatically optimized even if the paper feed-out level which is initially set by the user is improper or the thickness of the sheets in the stack fluctuates.

Though, in the automatic adjustment mode described above, the paper feed-out level A is corrected each time a printing paper P is fed out from the paper support table 51, the paper feed-out level may be corrected each time a predetermined number of printing papers P are fed out according to, for instance, an average of the thicknesses of the printing papers P. In this case, though the paper feed-out level is corrected or updated each time the predetermined number of printing papers P are fed out, the paper support table 51 is moved upward to return the uppermost printing paper for that time to the paper feed-out level A each time a printing paper is fed out. Further, the paper feed-out level may be corrected each time a predetermined number of printing papers P are fed out according to a median or a most frequent value of the thicknesses of the printing papers P.

Though, in the embodiment described above, the thickness of the printing papers P is initially set to one of the three values when the automatic adjustment mode is not selected and the paper feed-out level A is set to one of three levels, the thickness of the printing papers P may be initially set to one of four or more values so that the paper feed-out level A is set to one of the four more levels.

When the automatic adjustment mode is selected, the paper feed-out level A is adjusted according to the actual thicknesses of the printing papers P independently from the thickness of the printing papers P initially set by the user, and accordingly the automatic adjustment mode is useful especially when the quality and/or thickness of the printing paper P fluctuate from paper to paper.

Further it is possible to execute the automatic adjustment, that is, correction of the paper feed-out level A according to the thickness of the printing papers P, irrespective of whether the user selects the automatic adjustment mode. In this case, the paper feed-out level A is set according to the thickness of the printing paper P selected by the user only for a first printing paper and the paper feed-out level A for a second printing paper P is corrected according to the thickness of the first printing paper. Further it is possible to arrange the system so that the paper feed-out level A is initially set to a fixed value which cannot be selected by the user and the automatic adjustment is constantly carried out. In this case, the paper feed-out level A is set to the fixed value irrespective of the thickness of the printing paper P for a first printing paper and the fixed paper feed-out level A is corrected according to the thickness of the first printing paper when a second printing paper is to be fed out.

The thicknesses of the printing papers P calculated in step SP12 may be employed for controlling other systems connected to the printing paper supply system.

Figure 5:
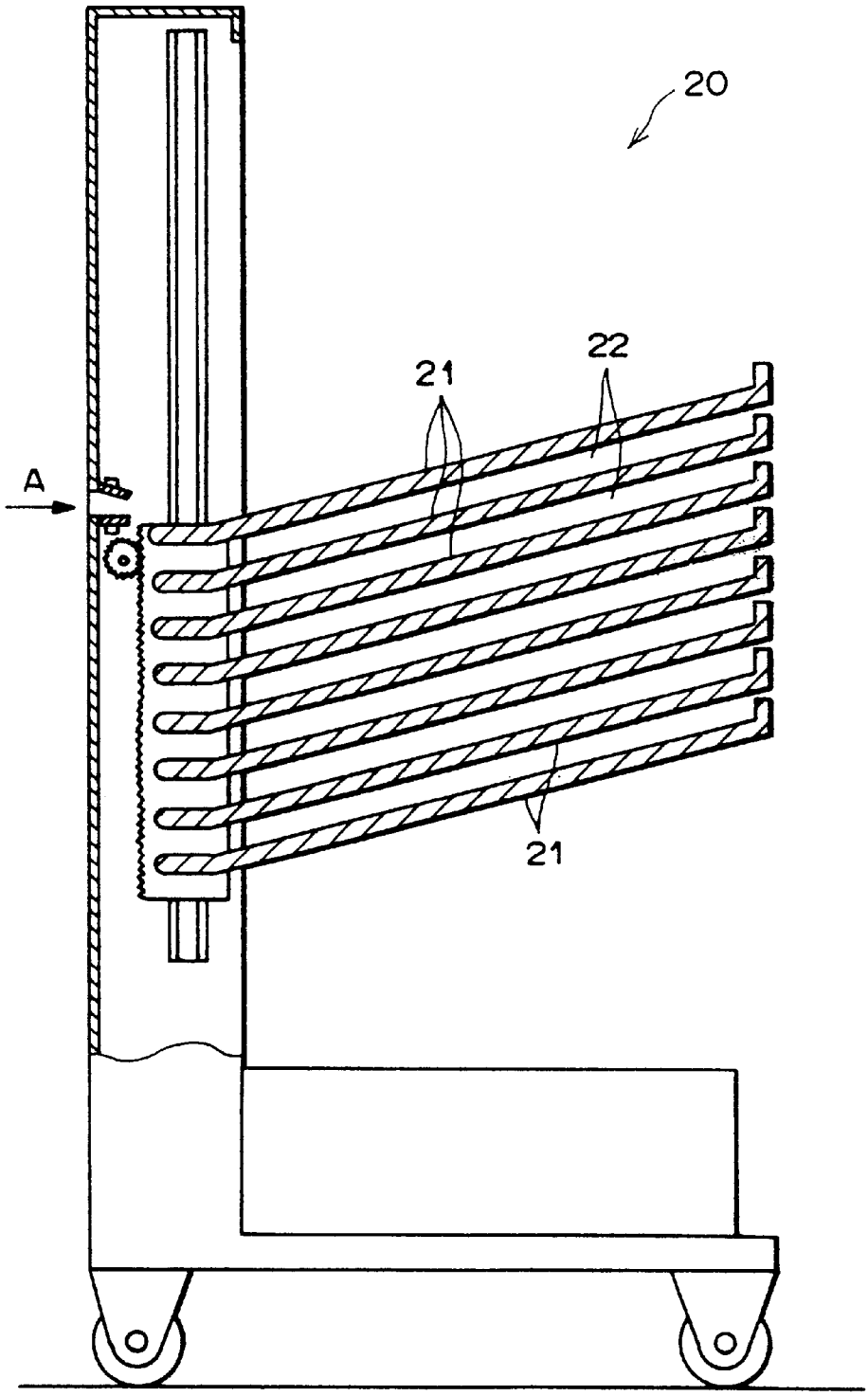
FIG. 5 is a schematic side view of a sorter.

For example, the thicknesses of the printing papers P calculated in step SP12 may be employed for controlling a sorter 20 shown in FIG. 5 connected to a printer. In this case, the paper supply system is for supplying printing papers P to the printer. In FIG. 5, copies discharged from the printer are delivered to the sorter 20 in the direction of arrow A. The sorter 20 comprises a plurality of bins 21 which are arranged in the vertical direction and are moved up and down so that the copies sent from the printer are distributed to the bins 21 to form a stack in each bin 21. The bins 21 are spaced from each other by spaces 22.

A maximum number of copies which can be accommodated in each bin 21 is calculated according to the following equation on the basis of the thickness of the printing paper P calculated by the CPU 1 in step SP12 and the height of the space 22 which is known.

maximum number=(height of the space 22)/(thickness C of the printing paper)

Strictly speaking, the height of the space 22 should be valued slightly smaller than the actual value since the space 22 cannot be fully filled with copies.

Then the sorter 20 is controlled on the basis of the maximum number of copies thus calculated.

Figure 6:
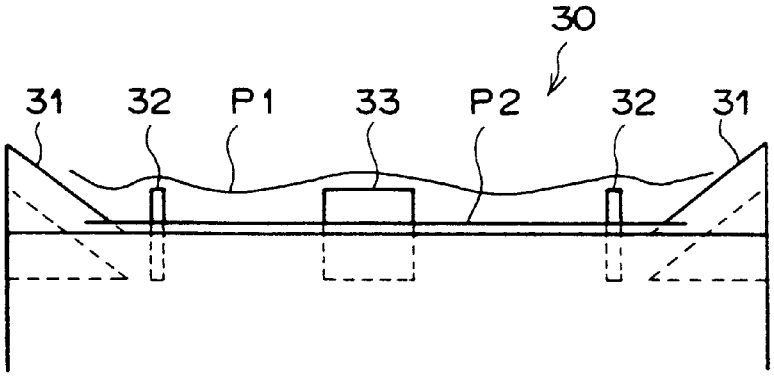
FIG. 6 is a schematic front view of a paper discharge system.

The thicknesses of the printing papers P calculated in step SP12 may be employed for controlling a paper discharge system 30 of a printer shown in FIG. 6.

For example, in a stencil printer, copies P separated from a printing drum are conveyed by the paper discharge system 30. The paper discharge system 30 comprises an endless belt and a suction means and the copies P are conveyed while attracted against the endless belt by the suction means. A pair of wings 31 and a pair of side flaps 32 are disposed near the respective side edges of the endless belt and a roller 33 is disposed at the center of the endless belt. The wings 31, the side flaps 32 and the roller 33 are movable up and down to be projected upward beyond the upper surface of the endless belt and to be retracted below the upper surface of the endless belt.

The paper discharge system 30 controls the amount by which the wings 31, the side flaps 32 and the roller 33 are projected above the upper surface of the endless belt in order to change an apparent rigidity of the printing paper P during conveyance thereof.

That is, when a thin printing paper P1 is conveyed, the wings 31, the side flaps 32 and the roller 33 are projected above the upper surface of the endless belt as shown by the solid line, whereby the leading end portion of the printing paper P1 is curved by the wings 31, the side flaps 32 and the roller 33. When the leading end portion is curved, the apparent rigidity of the printing paper P1 is increased and the printing paper P1 can be stably conveyed without the leading end portion sagging down from the endless belt.

When a relatively thick printing paper P2 is conveyed, the wings 31, the side flaps 32 and the roller 33 are retracted below the upper surface of the endless belt as shown by the broken line, whereby the thick printing paper P2 can be stably conveyed without interference with the wings 31, the side flaps 32 and the roller 33.

Though, in the embodiment described above, the level sensor 5 is of a reflection type which emits a light beam toward a reflecting plate 53*b* fixed to the paper feed-out unit 53 and receives reflected light from the reflecting plate 53*b*, the level sensor 5 may be of various types provided that it can continuously detect the level of the paper feed-out unit 53, i.e., the level of the uppermost printing paper.

Figure 7:
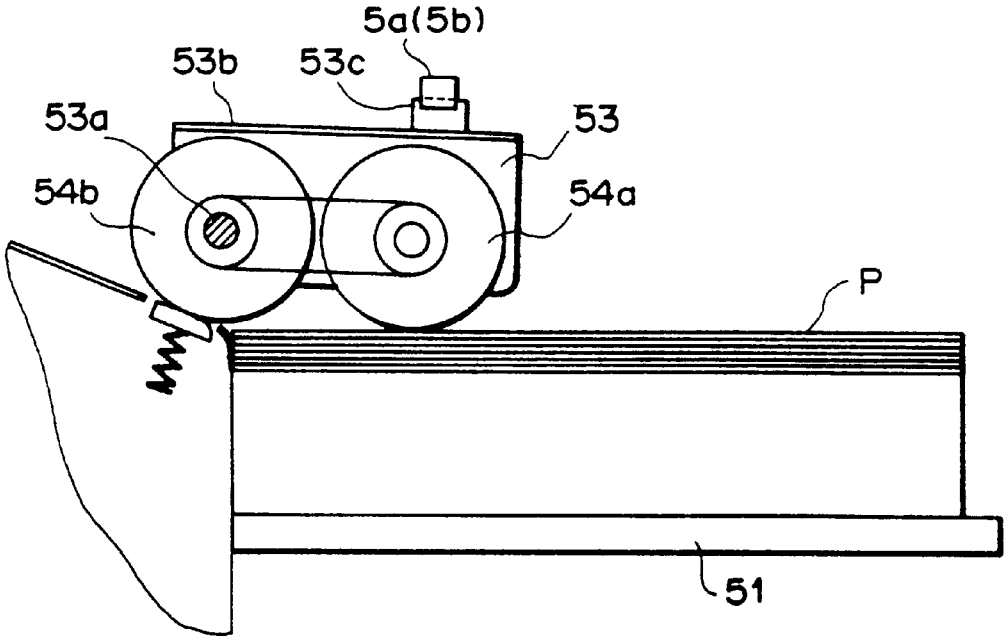
FIG. 7 is a side view showing a modification of the level sensor.

For example, the level sensor may comprise a light emitting element 5*a* and a light receiving element 5*b* which are spaced from each other as shown in FIG. 7. The light receiving element 5*b* outputs a signal which changes with the amount of light which it receives. A detecting flap 53*c* is mounted on the paper feed-out unit 53 to be inserted between the light emitting element 5*a* and the light receiving element 5*b*. As the paper feed-out unit 53 is moved upward, the detecting flap 53*c* is inserted more deeply between the light emitting element 5*a* and the light receiving element 5*b*, whereby the amount light received by the light receiving element 5*b* is reduced. Accordingly, by detecting the output of the light receiving element 5*b*, the level of the paper feed-out unit 53 or the level of the uppermost printing paper can be known.

Though, in the embodiment described above, the level sensor 5 is positioned to detect the level of the uppermost printing paper by way of the level of the paper feed-unit 53, it may be positioned to detect the level of the paper support table 51 or the level of the uppermost printing paper.

What is claimed is:

1. A sheet supply system comprising a sheet support table which is movable up and down and on which a stack of a plurality of sheets are supported, a sheet feed-out means which feeds out the sheets on the sheet support table one by one from the uppermost one, a table drive means which moves the sheet support table up and down relative to the sheet feed-out means, a contactless and non-discrete level sensor which detects the level of the uppermost sheet on the sheet support table via the sheet feed-out means, a sheet feed-out level setting means for initially setting a sheet feed-out level at which the uppermost sheet is kept during sheet supply operation of the system, and a control means which actuates the table drive means to move upward the sheet support table when the level of the uppermost sheet on the sheet support table as detected by the level sensor lowers by a predetermined value from the sheet feed-out level as set by the sheet feed-out level setting means and stops the table drive means when the level of the uppermost sheet on the sheet support table as detected by the level sensor reaches the sheet feed-out level.

2. A sheet supply system as defined in claim 1 in which said sheet feed-out means comprises a sheet supply roller and the uppermost sheet on the sheet support table is held in contact with the sheet supply roller when it is in the sheet feed-out level.

3. A sheet supply system as defined in claim 2 in which said sheet supply roller is held to be movable up and down and is moved upward pushed by the stack of sheets when the sheet support table is moved upward to bring the uppermost sheet to the sheet feed-out level, the sheet supply roller being urged downward so that the contact pressure between the sheet supply roller and the uppermost sheet on the sheet supply table increases as the sheet feed-out level becomes higher.

4. A sheet supply system as defined in claim 3 in which the level sensor detects the level of the uppermost sheet by way of the level of the sheet supply roller.

5. A sheet supply system as defined in claim 4 in which said control means actuates the table drive means to move upward the sheet support table when the level of the uppermost sheet on the sheet support table as detected by the level sensor lowers from the sheet feed-out level by a value equal to the thickness of one sheet.

6. A sheet supply system as defined in claim 1 in which said control means includes a correction means which changes said sheet feed-out level set by the sheet feed-out level setting means according to the thickness of each sheet as calculated on the basis of reduction in the level of the uppermost sheet as detected by the level sensor which is caused each time a sheet is fed out from the sheet support table.

7. A sheet supply system as defined in claim 6 in which said sheet feed-out means comprises a sheet supply roller and the uppermost sheet on the sheet support table is held in contact with the sheet supply roller when it is in the sheet feed-out level.

8. A sheet supply system as defined in claim 7 in which said sheet supply roller is held to be movable up and down and is moved upward pushed by the stack of sheets when the sheet support table is moved upward to bring the uppermost sheet to the sheet feed-out level, the sheet supply roller being urged downward so that the contact pressure between the sheet supply roller and the uppermost sheet on the sheet supply table increases as the sheet feed-out level becomes higher.

9. A sheet supply system as defined in claim 8 in which the level sensor detects the level of the uppermost sheet by way of the level of the sheet supply roller.

10. A sheet supply system as defined in claim 9 in which said control means actuates the table drive means to move upward the sheet support table when the level of the uppermost sheet on the sheet support table as detected by the level sensor lowers from the sheet feed-out level by a value equal to the thickness of one sheet.

11. A sheet supply system comprising a sheet support table which is movable up and down and on which a stack of a plurality of sheets are supported, a sheet feed-out means which feeds out the sheets on the sheet support table one by one from the uppermost one, a table drive means which moves the sheet support table up and down relative to the sheet feed-out means, a contactless and non-discrete level sensor which detects the level of the uppermost sheet on the sheet support table via the sheet feed-out means, a control means which actuates the table drive means to move upward the sheet support table when the level of the uppermost sheet on the sheet support table as detected by the level sensor lowers from a predetermined sheet feed-out level by a predetermined value and stops the table drive means when the level of the uppermost sheet on the sheet support table as detected by the level sensor reaches the sheet feed-out level and, a correction means which changes said sheet feed-out level according to the thickness of each sheet as calculated on the basis of reduction in the level of the uppermost sheet as detected by the level sensor which is caused each time a sheet is fed out from the sheet support table.

* * * * *